US008282445B2

(12) United States Patent
Goldberg et al.

(10) Patent No.: US 8,282,445 B2
(45) Date of Patent: Oct. 9, 2012

(54) FLOOR FINISHING APPARATUS

(75) Inventors: Jay Michael Goldberg, Englewood, NJ (US); Steven Remer, Newburgh, NY (US); Floyd Johnson, New Windsor, NY (US)

(73) Assignee: Onfloor Technologies, L.L.C., Newburgh, NY (US)

( * ) Notice: Subject to any disclaimer, the term of this patent is extended or adjusted under 35 U.S.C. 154(b) by 1412 days.

(21) Appl. No.: 11/880,339

(22) Filed: Jul. 20, 2007

(65) Prior Publication Data

US 2009/0019652 A1 Jan. 22, 2009

(51) Int. Cl.
*B24B 23/02* (2006.01)

(52) U.S. Cl. ..... 451/353; 451/350

(58) Field of Classification Search ..... 451/350, 451/353, 359, 352; 125/13.01, 38
See application file for complete search history.

(56) References Cited

U.S. PATENT DOCUMENTS

| | | | | |
|---|---|---|---|---|
| 943,727 | A | | 12/1909 | Albers et al. |
| 1,601,087 | A | | 9/1926 | Simpson |
| 1,919,389 | A | | 7/1933 | Myers |
| 1,928,390 | A | | 9/1933 | Myers |
| 1,988,193 | A | | 1/1935 | Edstrom |
| 2,007,073 | A | | 7/1935 | Clarke |
| 2,171,060 | A | | 8/1939 | De Spirt |
| 2,298,054 | A | | 10/1942 | Howell |
| 2,300,138 | A | | 10/1942 | Steele |
| 3,098,329 | A | | 7/1963 | Doran |
| 3,128,581 | A | | 4/1964 | Tosetti |
| 3,129,539 | A | | 4/1964 | Tempero |
| 3,169,262 | A | | 2/1965 | Allen et al. |
| 3,190,672 | A | | 6/1965 | Swanson et al. |
| 3,354,488 | A | | 11/1967 | Blide |
| 3,701,221 | A | * | 10/1972 | Vinella ..... 451/353 |
| 3,721,048 | A | | 3/1973 | Rand |
| 4,010,507 | A | | 3/1977 | Johnson |
| 4,097,950 | A | | 7/1978 | Satterfield |
| 4,150,456 | A | | 4/1979 | Alvarez et al. |
| 4,155,596 | A | | 5/1979 | Brejcha |
| 4,182,001 | A | | 1/1980 | Krause |
| 4,186,967 | A | | 2/1980 | Kuhmonen |
| 4,273,384 | A | | 6/1981 | Freeburn |
| 4,319,434 | A | | 3/1982 | Brejcha |
| 4,570,388 | A | | 2/1986 | Tano et al. |
| 4,634,188 | A | | 1/1987 | Persson |
| 4,654,918 | A | * | 4/1987 | Cooper ..... 15/98 |
| 4,709,510 | A | | 12/1987 | Giovanni et al. |
| 4,719,659 | A | | 1/1988 | Urakami |
| 4,862,548 | A | | 9/1989 | Sergio |
| 4,862,766 | A | | 9/1989 | Molders |
| 5,054,245 | A | | 10/1991 | Coty |
| 5,080,525 | A | | 1/1992 | Bircher et al. |

(Continued)

OTHER PUBLICATIONS

Website Product Listing for HTC 2500 iX, Industrialized, 2 pages, copyright 2006.

(Continued)

*Primary Examiner* — Robert Rose
(74) *Attorney, Agent, or Firm* — Reising Ethington P.C.

(57) ABSTRACT

A floor finishing apparatus includes a chassis, a housing pivotably mounted to the chassis and having a mounting surface and at least partially defining a chamber, and a plurality of floor finishing units mounted to the mounting surface of the housing. The apparatus may include a rolling device carried by the housing and adapted to contact the ground to assist the housing in being pivoted with respect to the chassis.

20 Claims, 10 Drawing Sheets

U.S. PATENT DOCUMENTS

| | | | |
|---|---|---|---|
| 5,170,595 | A | 12/1992 | Wiand |
| 5,209,961 | A | 5/1993 | Yokoi |
| 5,224,301 | A | 7/1993 | Tasikas |
| 5,314,386 | A | 5/1994 | Eide et al. |
| RE34,822 | E | 1/1995 | Mattson |
| 5,377,375 | A | 1/1995 | Holman et al. |
| 5,416,943 | A | 5/1995 | Weltikol |
| 5,439,413 | A | 8/1995 | Lagler |
| 5,454,751 | A | 10/1995 | Wiand |
| 5,507,061 | A | 4/1996 | Miyazaki |
| 5,524,320 | A | 6/1996 | Zachhuber |
| 5,575,710 | A | 11/1996 | Kramer |
| 5,632,625 | A | 5/1997 | Faust |
| 5,637,032 | A | 6/1997 | Thysell et al. |
| 5,643,047 | A | 7/1997 | Beckett et al. |
| 5,683,143 | A | 11/1997 | Peterson et al. |
| 5,765,250 | A | 6/1998 | Lee |
| 5,772,497 | A | 6/1998 | Dummermuth |
| 5,788,561 | A | 8/1998 | Pearlman et al. |
| 5,816,739 | A | 10/1998 | Allen |
| 5,829,095 | A | 11/1998 | Legatt et al. |
| 5,863,241 | A | 1/1999 | Rottschy |
| 5,875,506 | A | 3/1999 | Plazanet |
| 5,905,927 | A | 5/1999 | Inoue et al. |
| 5,980,371 | A | 11/1999 | McConnell |
| 6,148,476 | A | 11/2000 | Legatt et al. |
| 6,202,775 | B1 | 3/2001 | Mattson et al. |
| 6,227,957 | B1 | 5/2001 | Legatt et al. |
| 6,238,277 | B1 | 5/2001 | Duncan et al. |
| 6,261,164 | B1 | 7/2001 | Rivard et al. |
| 6,295,682 | B1 | 10/2001 | Klucznik |
| 6,315,648 | B1 | 11/2001 | Neer |
| 6,331,138 | B1 | 12/2001 | Witters et al. |
| 6,353,957 | B1 | 3/2002 | Wolfe et al. |
| 6,419,565 | B2 | 7/2002 | Mattson et al. |
| 6,450,867 | B1 | 9/2002 | Legatt |
| 6,475,067 | B1 | 11/2002 | Jones et al. |
| 6,485,360 | B1 | 11/2002 | Hutchins |
| 6,494,772 | B1 | 12/2002 | Barnes et al. |
| 6,523,906 | B1 | 2/2003 | Holder |
| 6,561,813 | B2 | 5/2003 | Rutten et al. |
| 6,595,838 | B1 | 7/2003 | Palushi et al. |
| 6,616,517 | B2 | 9/2003 | Palushi |
| 6,752,707 | B1 | 6/2004 | Palushi |
| 6,836,919 | B2 | 1/2005 | Shinler |
| 7,261,623 | B1 * | 8/2007 | Palushi ..... 451/350 |
| 2002/0179116 | A1 | 12/2002 | Shinler |
| 2007/0232207 | A1 | 10/2007 | Palushi |

OTHER PUBLICATIONS

Website Product Listing for HTC 1500 ixT, Industrialized, 2 pages, copyright 2006.

Website Product Listing for HTC 950 RX, 2 pages, copyright 2006.

Website Product Lisiting for HTC 800 HDX, 2 pages, copyright 2006.

Website Product Listing for HTC 800 Classic, 1 page, copyright 2006.

Website Product Listing for HTC 650 HDX, 2 pages, copyright 2006.

Website Product Listing for HTC 500, 1 page, copyright 2006.

Website Product Listing for HTC 420, 1 page, copyright 2006.

Website Product Listing for HTC 400, 1 page, copyright 2006.

Website Product Listing for HTC 130 Edge Grinder, 1 page, Copyright 2006.

Alto, American Sanders Technology, Alto U.S. Inc., 390 South Woods Mills Road, Chesterfield, Missouri 63017-3433, Catalog (2 pages), copyright 1999.

Lagler, Palo Duro Hardwoods, Inc., 4800 Lima Street, Denver, Colorado 80239, Catalog (2 pages), NDN.

Cimex International, 100 Stradtman Street, Buffalo, New York 14206, Catalog (4 pages), copyright 1994.

Innovatech, 19722 144th Avenue, NE, Woodinville, Washington 98072, Catalog (4 pages), NDN.

* cited by examiner

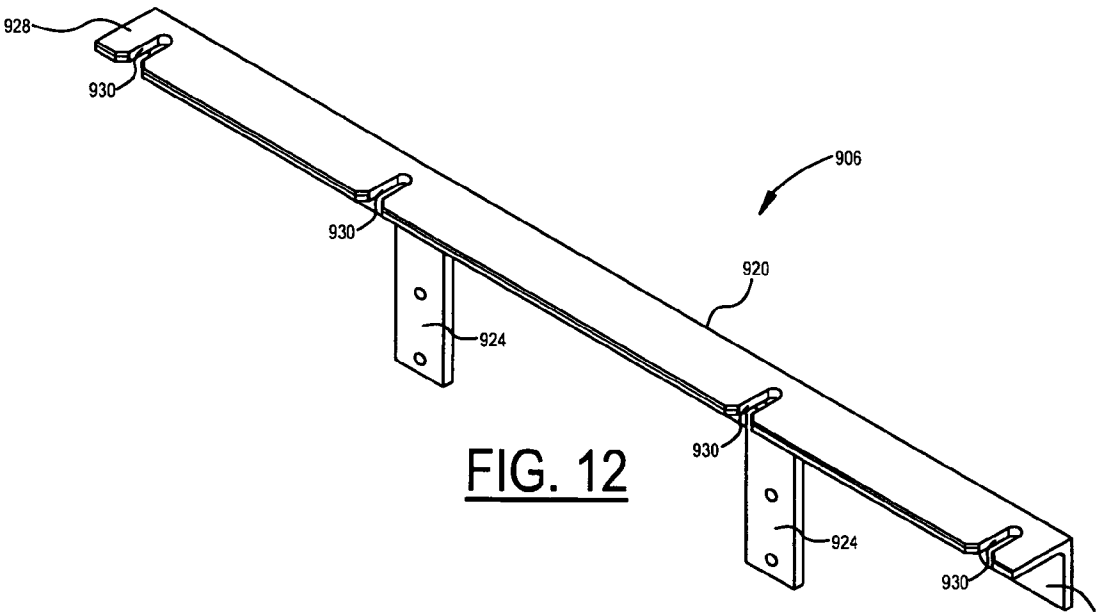
FIG. 12
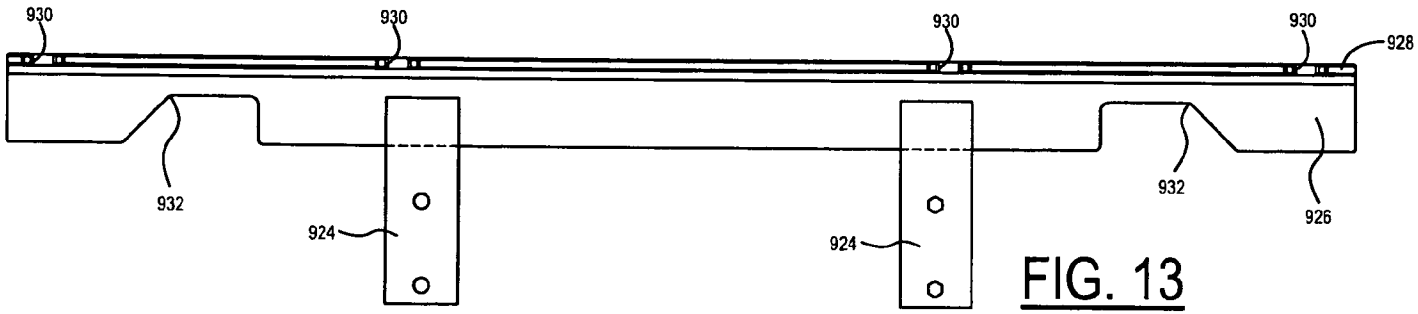
FIG. 14
FIG. 13
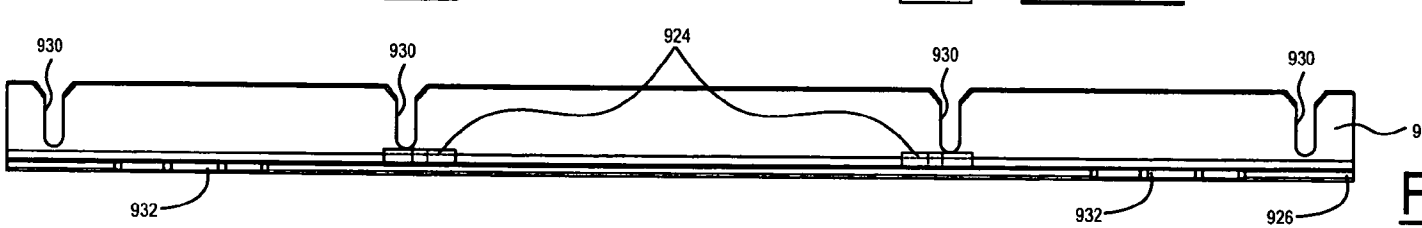
FIG. 15

FLOOR FINISHING APPARATUS

TECHNICAL FIELD

The field of this invention relates to floor finishing machines and related apparatus.

BACKGROUND OF THE DISCLOSURE

Hardwood floors have long been a desirable trait in a home and are also common in gymnasiums, bowling alleys, and ballrooms. However, sanding and refurbishing a hardwood floor is one of the more difficult do-it-yourself tasks for a homeowner or business owner. And, although concrete or cement is a very popular material for use in floors and construction materials because of its strength, durability and low costs, if the concrete or cement is left unfinished, the concrete floor will inherently produce dust by the constant scuffing it undergoes whether by foot traffic or wheeled traffic and be susceptible to staining due to porosity.

SUMMARY OF THE DISCLOSURE

In accordance with one aspect of the invention, there is provided a floor finishing apparatus including a chassis, a housing pivotably mounted to the chassis and having a mounting surface and at least partially defining a chamber, and a plurality of floor finishing units mounted to the mounting surface of the housing. The apparatus may include a rolling device carried by the housing and adapted to contact the ground to assist the housing in being pivoted with respect to the chassis.

In another embodiment of the present invention, there is provided a floor finishing apparatus including a chassis, a plurality of finishing units disposed frontwardly of the chassis, a handle coupled to the chassis and extending rearwardly from the chassis, and a trailer carrying at least a portion of a vacuum system, being coupled to the chassis, and extending rearwardly from the chassis.

BRIEF DESCRIPTION OF THE DRAWINGS

Reference now is made to the accompanying drawings in which:

FIG. 12 is a perspective view of the tow bar shown in FIG. 10;

FIG. 13 is a top plan view of the tow bar shown in FIG. 10;

FIG. 14 is an end elevational view of the tow bar shown in FIG. 10; and

FIG. 15 is a front elevational view of the tow bar shown in FIG. 10.

DETAILED DESCRIPTION

Referring now to FIGS. 1-11 illustrate presently preferred embodiments of a floor finishing apparatus 700. This embodiment is similar in many respects to exemplary equipment disclosed in U.S. Pat. No. 7,621,623, application Ser. No. 10/628,531, which is assigned to the assignee hereof and is incorporated herein by reference in its entirety.

Figure 1:
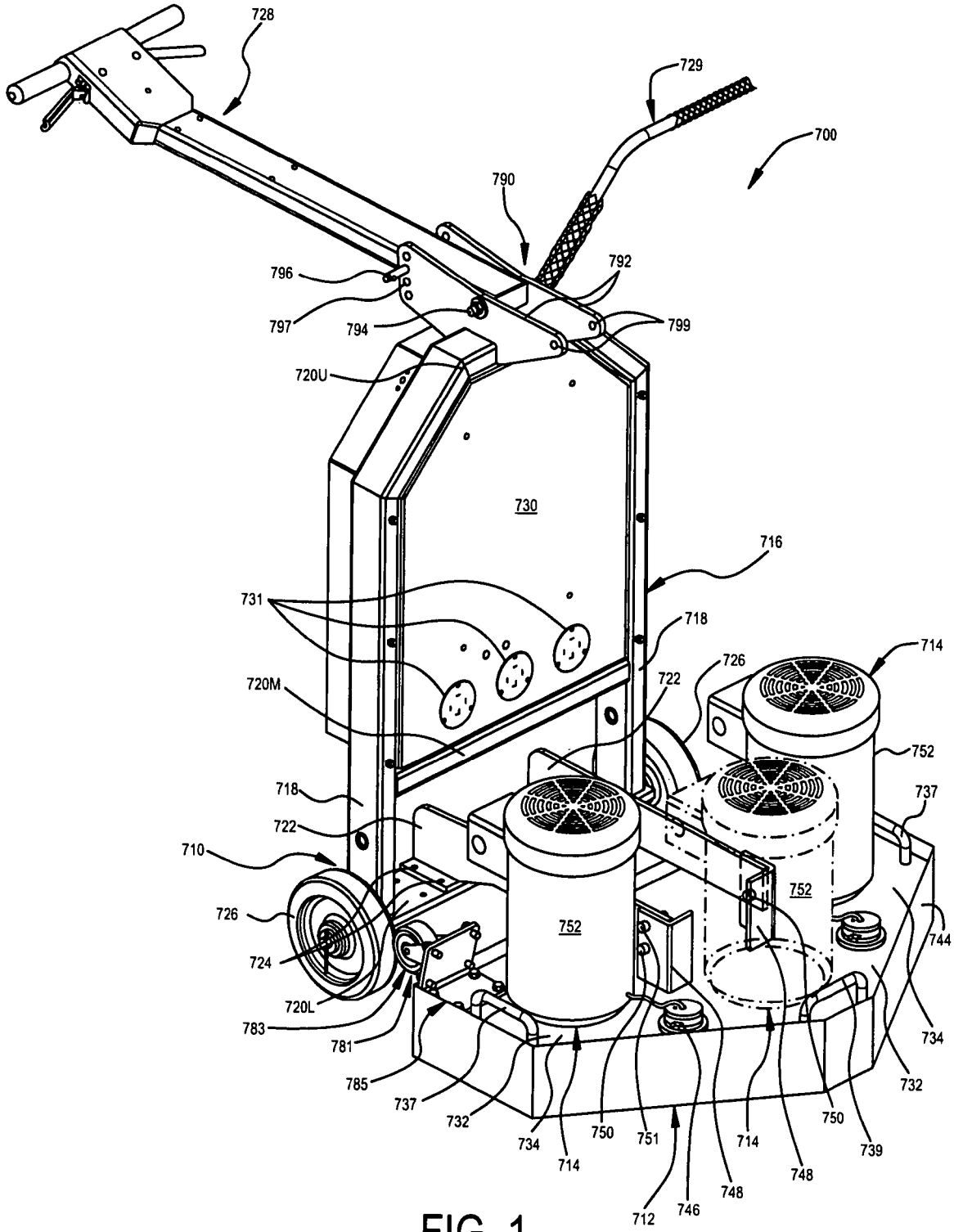
FIG. 1 is a perspective view of a floor finishing apparatus according to a further alternative embodiment of the present invention.

Referring now generally to FIGS. 1-9 and, particularly, to FIG. 1, the apparatus 700 may include a chassis 710, a housing 712 supported by and mounted to the chassis 710, and floor finishing units 714 disposed frontwardly of the chassis 710 and being supported by and mounted to the housing 712 for finishing a floor. The floor finishing units 714 may be arranged in a delta pattern as shown.

The chassis 710 may include a frame 716 that may be welded, fastened, or otherwise joined together from uprights 718 and one or more generally horizontal crossmembers 720U, 720M, 720L. Attached to the frame 716 at the lower crossmember 720L are one or more support arms 722 for supporting the housing 712. The support arms 722 may be fastened to the frame 716 with fasteners 724 such as bolts, cap screws, or the like, or may be welded to the frame 716, or joined in any other suitable manner. The support arms 722 may be cantilevered from the crossmember 720L and may terminate in free ends. The chassis 710 may also include wheels 726 rotatably mounted thereto, thereby permitting the apparatus 700 to be moved about like a dolly or hand truck.

The chassis 710 may carry an electrical service panel 730, which may be mounted between the uprights 718 and between crossmembers 720U, 720M of the chassis 710. The service panel 730 may be supplied with power via a power conduit 729 flexibly coupled thereto. The service panel 730 may include a plurality of electrical sockets 731 to which the plurality of floor finishing units 714 may be coupled. At an upper end of the frame 716, a handle 728 may facilitate movement of the apparatus 700 and may be coupled to the chassis 710 in any suitable manner, for example, by being attached to the frame 716 with a handle adjustment mechanism 790 and extending rearwardly of the chassis 710 in normal operation.

The handle adjustment mechanism 790 may include plates 792 attached or welded to the uprights 718 or, as shown, to the somewhat U-shaped upper crossmember 720U. The handle adjustment mechanism 790 may also include a pivot pin 794 carried through the plates 792 and a fixed end of the handle 728 so as to pivotably mount the handle 728 to the chassis 710. The plates 792 may include a plurality of adjustment holes 797 through which a handle pin 796 may be removably inserted, wherein the pin 796 may also extend through a portion of the handle 728 to fix the handle 728 in one of several adjustment positions. The plates 792 may also include at least one handle storage hole 799 through which the handle pin 796 may be removably inserted. The pin 796 may extend through a portion of the handle 728 after it is pivoted about the pin 794 to a storage position extending over the housing 712 and in general alignment with the storage hole 799.

The housing 712 may include a deck 732, which may be stamped or formed from sheet metal. The deck 732 may include a top or mounting surface 734, an underside or fastening surface (not shown), and may at least partially define a chamber. The housing 712 may also include a skirt 744 that peripherally mounts to and surrounds the deck 732 and that seals or partially defines the chamber. The skirt 744 may be composed of any suitable material such as a polymeric material, brush material, or the like. One or more vacuum ports 746 may be provided through the mounting surface 734 to fluidly communicate the chamber externally of the housing 712. As is well known in the art, the vacuum ports 746 may be vented by either an on-board vacuum system or a remote vacuum system (not shown).

One or more mounts 748 may be rigidly attached to the mounting surface 734 of the deck 732, such as by welding, fastening, or the like. The mounts 748 are pivotably attached to free ends of the support arms 722 by pivot members 750, such as pins, bolts and nuts, and/or the like. Accordingly, the housing 712 may be pivotably attached or mounted to the chassis 710. One or more additional pins 751 may be removably carried through at least one of the support arms 722 and mounts 748 to pivotably fix the housing 712 in position with respect to the chassis 710.

The apparatus 700 may also include one or more rolling devices 781 carried by the housing 712 and adapted to contact the ground G (FIGS. 2-3) to assist pivoting of the housing 712 with respect to the chassis 710. The rolling device(s) 781 include a mounting bracket 785 carried by the housing 712 in any suitable manner, and a wheel 783 attached to the mounting bracket 785. The wheel 783 is in the raised position as shown in FIG. 1. The mounting bracket 785 may be welded, fastened, or otherwise attached to the housing 712 and the wheel 783.

Also, the floor finishing apparatus 700 may include one or more handles 737, 739 carried by the housing 712 in any suitable manner to assist with pivoting of the housing 712 with respect to the chassis 710. For example, the handles 737, 739 may be fastened to the deck 732 of the housing 712.

Figure 2:
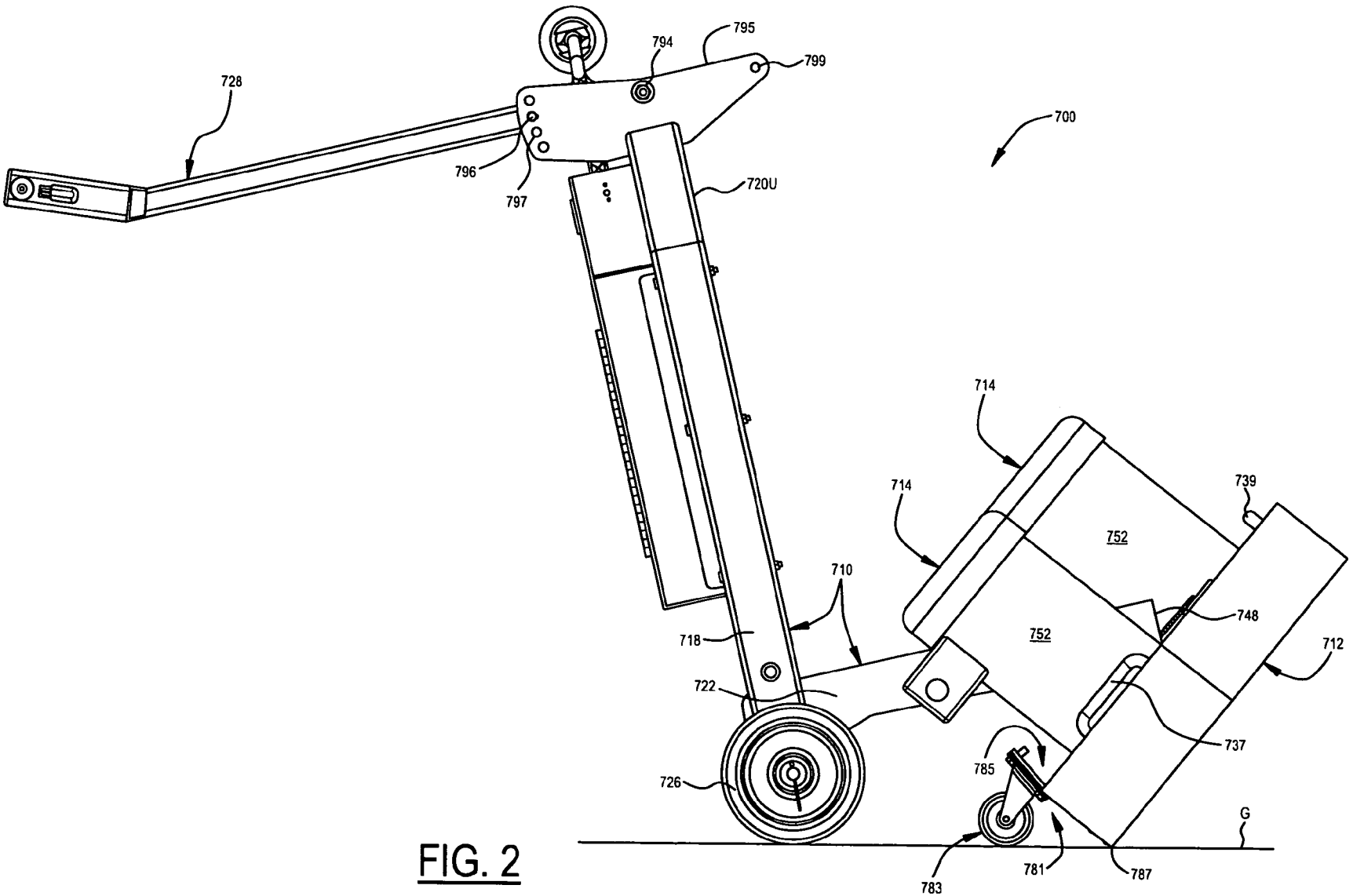
FIG. 2 is a side view of the floor finishing apparatus of FIG. 1, illustrating a housing being pivoted with respect to a chassis.

Referring to FIG. 2, the apparatus 700 is shown in an intermediate pivoted position, wherein the housing 712 has been pivoted with respect to the chassis 710 such that a lower rear edge 787 of the skirt 744 and the wheel 783 of the rolling device 781 contacts the ground G. The center of gravity of the housing 712 and floor finishing units 714 is between the lower rear edge 787 and the wheel 783 to provide a stable intermediate position. For example, an operator may remove the removable pin 751 (FIG. 1) and then lifted on one or more of the handles 737, 739 to pivot the housing 712 relative to the chassis 710.

Figure 3:
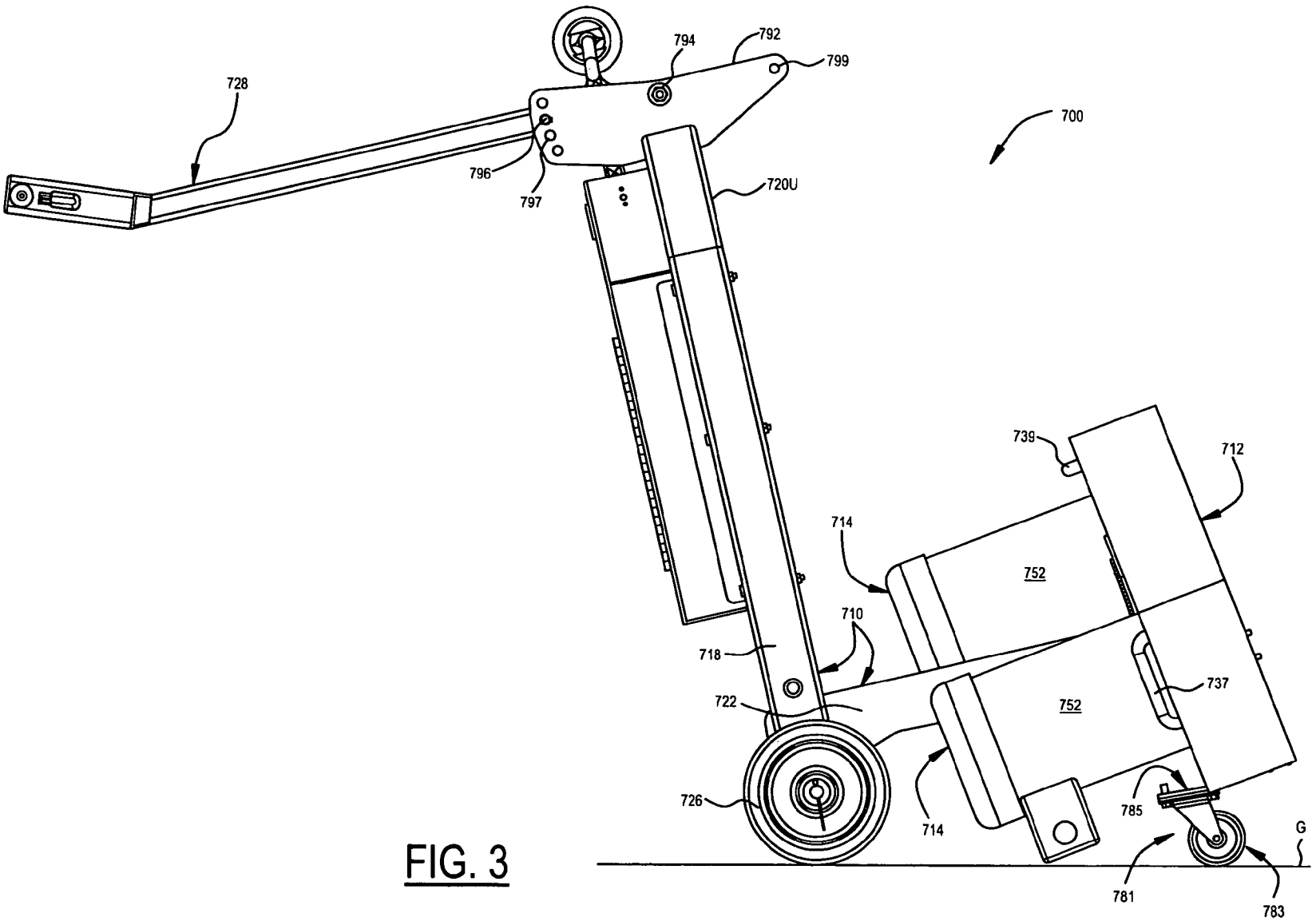
FIG. 3 is another side view of the floor finishing apparatus of FIG. 1, illustrating the housing pivoted to a pad change position with respect to the chassis.
Figure 4:
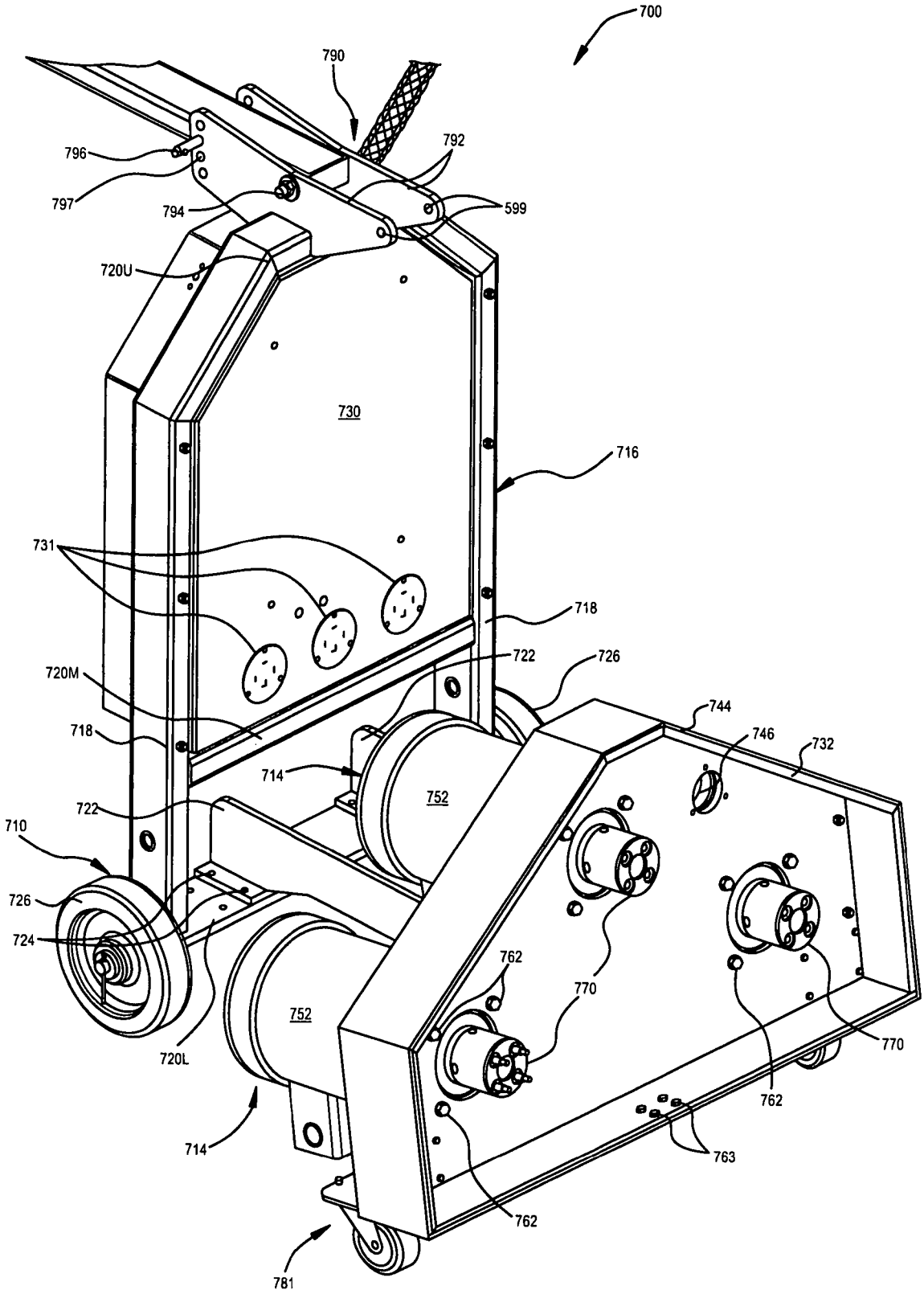
FIG. 4 is a perspective view of the floor finishing apparatus of FIG. 1, showing the pad change position of FIG. 3.

Referring to FIGS. 3 and 4, the operator may continue to pull on the handle(s) 737, 739 to further pivot the housing 712 with respect to the chassis 710 so that the underside of the housing 712 is exposed for a pad change or maintenance or transport, as shown. The center of gravity of the housing 712 and floor finishing units 714 is over center, to the rear of the pivot pin 750 (FIG. 1) and preferably to the rear of the wheel 783 to maintain a stable position during rolling of the apparatus 700. Accordingly, and as also shown in FIG. 4, the operator has easy access to the floor finishing units 714 such as to clean or replace finishing pads (not shown) or otherwise maintain the apparatus 700.

Figure 5:
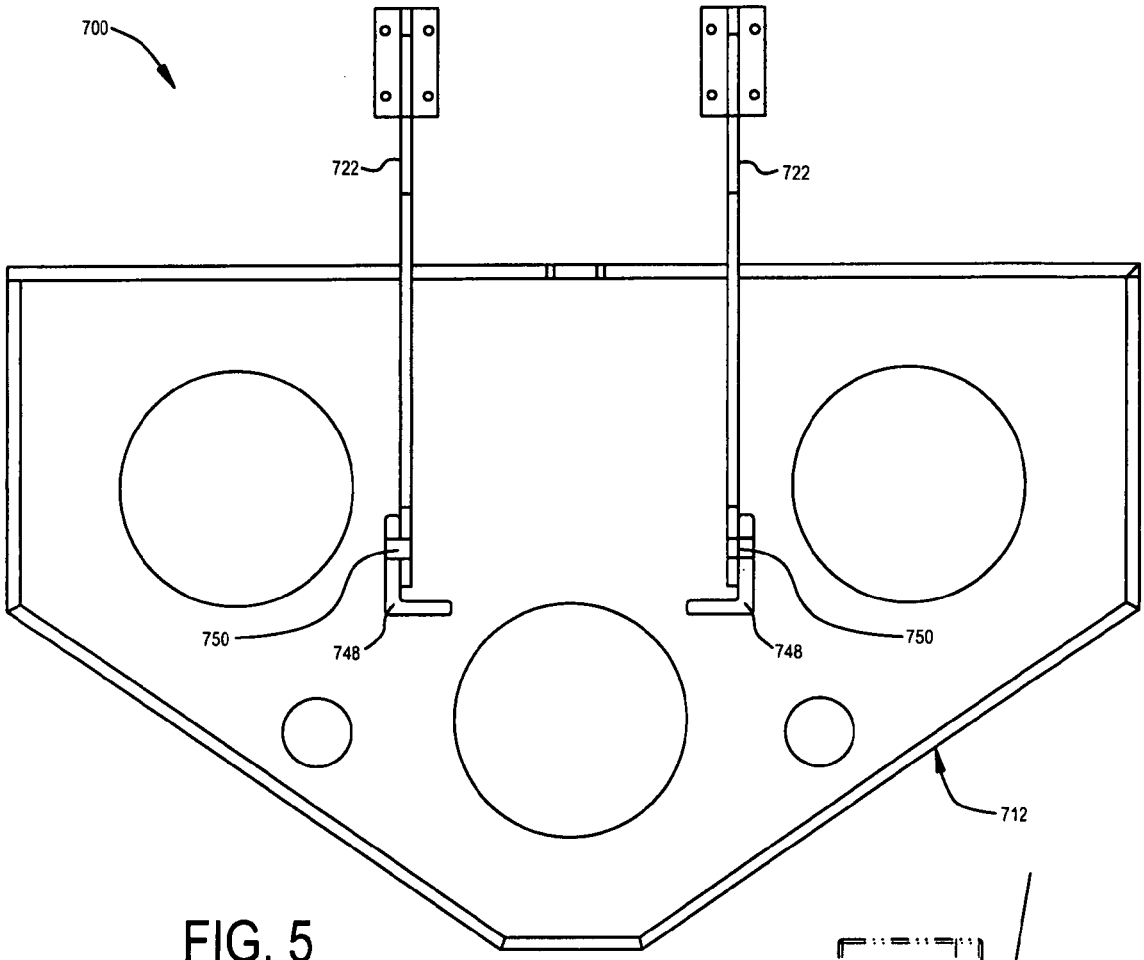
FIG. 5 is top view of a portion of the floor finishing apparatus of FIG. 1, showing a mounting arrangement between a chassis and a housing.
Figure 6:
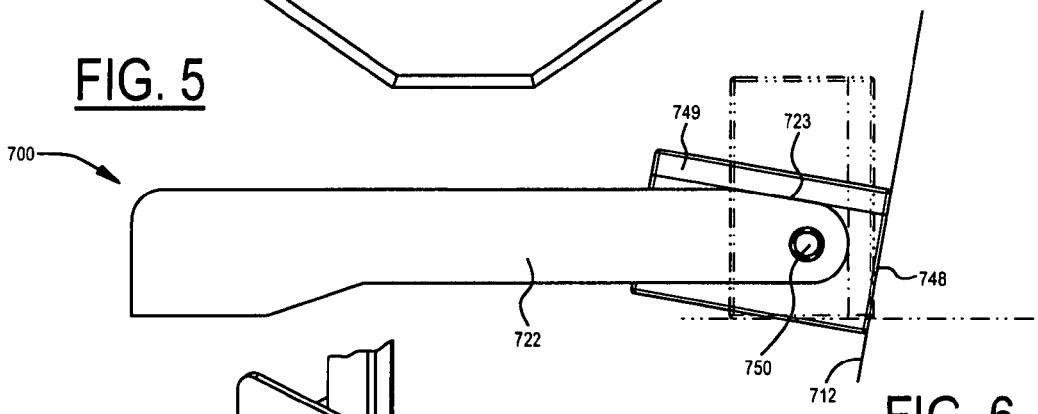
FIG. 6 is a side view of a portion of the floor finishing apparatus of FIG. 1, showing a mounting arrangement between a chassis and a housing.
Figure 7:
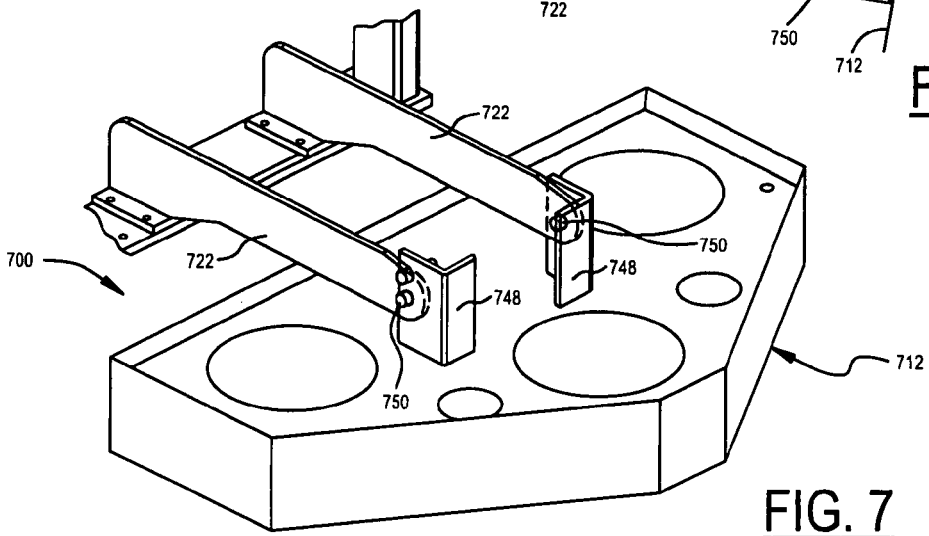
FIG. 7 is a perspective view of a portion of the floor finishing apparatus of FIG. 1, showing a mounting arrangement between a chassis and a housing.

Also, as shown in FIGS. 5-7, the apparatus 700 includes a device to prevent over rotation of the housing 712 and floor finishing units 714. As just one of many examples, the support arms 722 may include a flat angled portion 723 adapted to act as a stop for vertical flanges 749 of the mounts 748, so that over rotation of the housing 712 about the pivot member 750 is prevented to avoid damaging the floor finishing units (not shown).

Referring to FIG. 4, the floor finishing units 714 may be mounted to the housing 712 such as being fastened to the deck 732 by fasteners 762 such as bolts or cap screws that extend through the deck 732 and thread into portions of the motors 752. Drive shafts 770 extend from the motors 752 and terminate in finishing discs and pads (not shown) directly attached thereto using known mounting systems or hardware (not shown). The floor finishing units 714 are arranged as discussed above to diametrically overlap, such that the finishing discs and/or pads diametrically overlap one another as the apparatus 700 travels in operation. As also shown in FIG. 4, the skirt 744 may be fastened to a rear portion of the deck 732 with any suitable fasteners 763.

Figure 8:
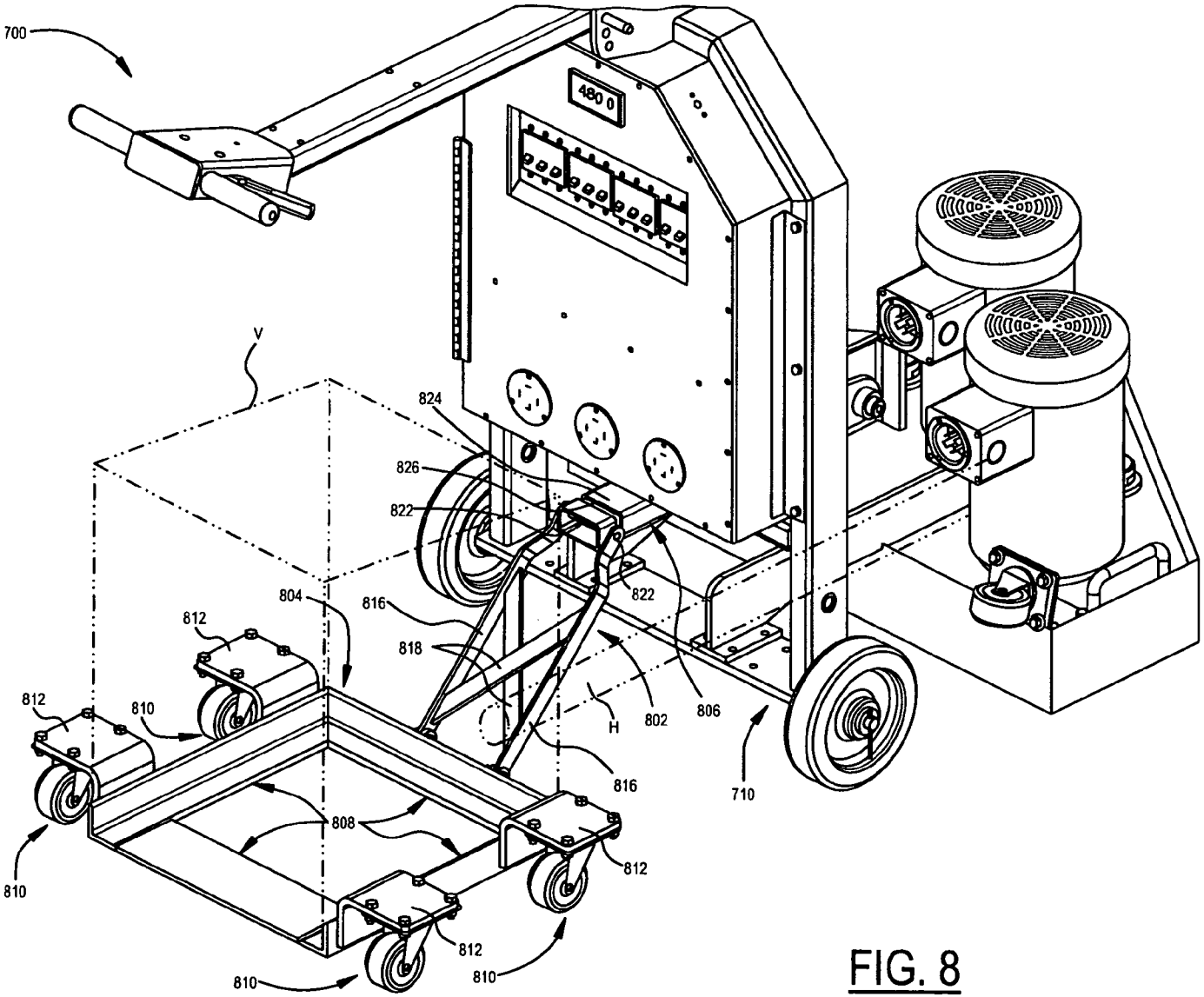
FIG. 8 is rear perspective view of the floor finishing apparatus of FIG. 1, illustrating a trailer coupled to a chassis of the machine.
Figure 9:
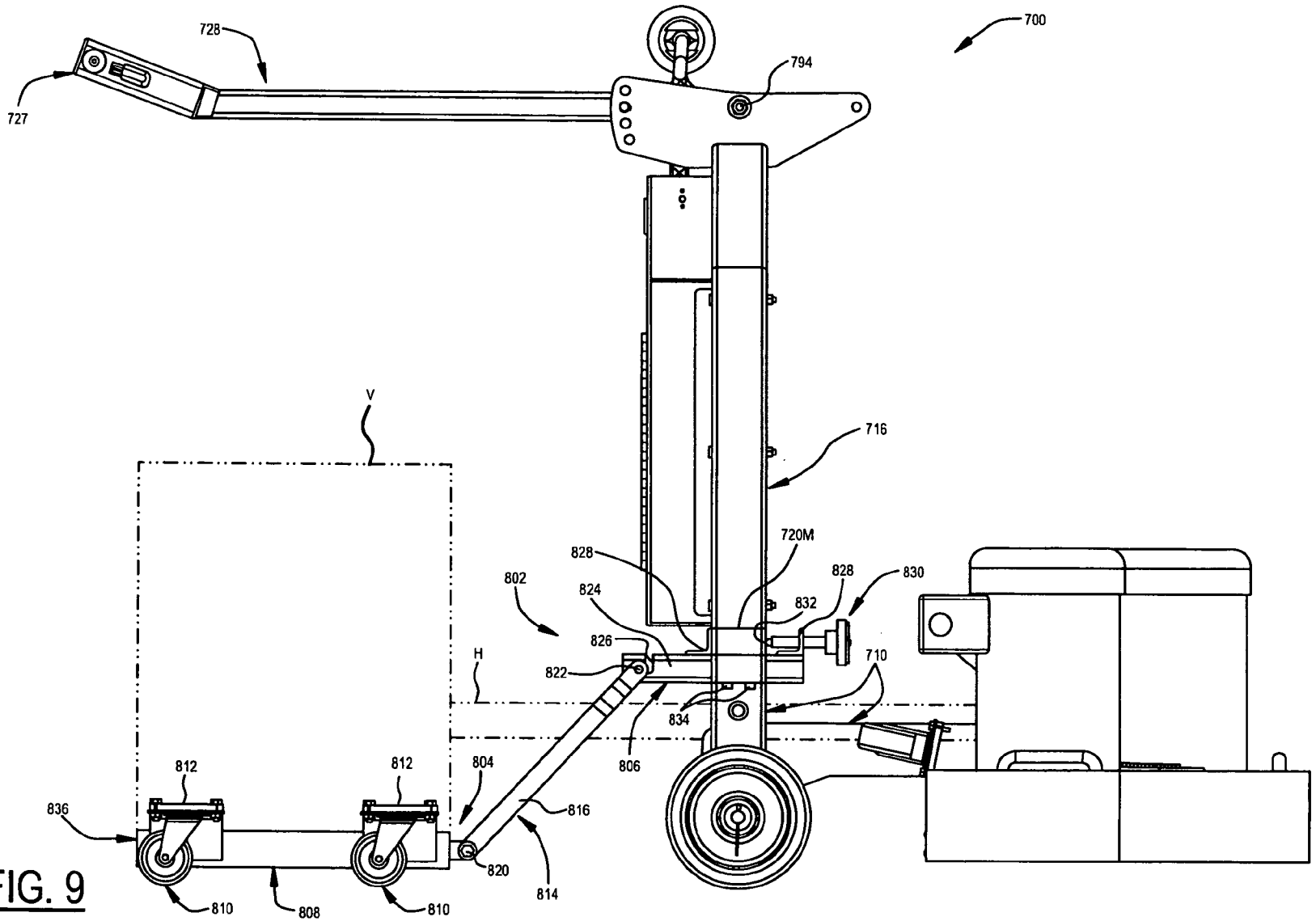
FIG. 9 is a side view of the floor finishing apparatus of FIG. 1, illustrating a trailer coupled to a chassis of the machine via a removable hitch.

FIGS. 8 and 9 illustrate an accessory arrangement 802 for the floor finishing apparatus 700. The accessory arrangement 802 may include a trailer 804 coupled to the chassis 710 of the apparatus 700 such as by being removably attachable to a hitch 806 carried by the apparatus 700. The accessory arrangement 802 may be used, for example, to carry a vacuum system V (FIG. 9) or a portion thereof, such that the trailer 804 may be a vacuum trailer. Vacuum hoses H may be in communication with the vacuum system V and with the chamber defined by the housing 712, as shown. The hoses H may be routed through the chassis 710, such as through the upright frame 716, so as to prevent the hoses H from being dragged on the floor.

The trailer 804 may include a frame 808, wheels 810, brackets 812 to mount the wheels 810 to the frame 808, and a link 814 to attach the trailer 804 to the hitch 806. The frame 808, brackets 810, and link 814 may be constructed according to any suitable shapes and sizes and from any suitable materials and components, for example, several angle irons and/or flat steel plates welded or fastened together, a unitary frame injection molded from plastic, or the like. All of the wheels 812, or any combination thereof, may be rotationally fixed types of wheels, or may be swivel or caster types of wheels, or the like. The link 814 may include arms 816, cross-members 818 (FIG. 8) welded or otherwise connected between the arms 816, a trailer pin 820 (FIG. 9) to pivotably couple the link 814 to the frame 808, and a hitch engagement feature 822 to pivotably couple the link 814 to the hitch 806. The hitch engagement feature 822 may be a pin as shown, or may instead include a socket, ball, or any other suitable engagement feature.

In turn, the hitch 806 may include a body 824 defining a trailer engagement feature 826 to accept hitch engagement feature 822 of the trailer 804. The trailer engagement feature 826 may be a slot as shown, or may instead include a ball, socket, or any other suitable engagement feature. The feature 826 may be of any suitable shape and may include a detent portion to prevent the hitch engagement feature 822 from becoming disengaged inadvertently. The body 824 may be constructed according to any suitable shapes and sizes and from any suitable materials and components, for example, open or closed channel stock, an injection molded component, or the like.

As shown in the side view of FIG. 9, the body 824 may be carried by the floor finishing apparatus 700 in any suitable manner. For example, the body 824 may be carried by the chassis 710. More specifically, the body 824 may be removably attached to the cross-member 720M of the upright frame 716 of the chassis 710. Even more specifically, attachment members 828 such as angle irons may be welded or otherwise carried by the body 824, wherein one of the attachment members 828 includes a hand screw 830 threaded therethrough. Accordingly, the hitch 806 may be adapted to be clamped to the cross-member 720M between an end 832 of the hand screw 830 and one of the attachment members 828. Alternatively, one or more fasteners 834 may be used to fix the hitch body 824 to the apparatus 700. According to another alternative, the hitch 806 could be an integral portion of the chassis 710 instead of a separately attached component.

Still referring to FIG. 9, the length of the trailer 804 and/or hitch 806 in the direction of travel is less than the length of the handle 728 when the trailer 804 is coupled to the chassis 710 and extending rearwardly thereof. In other words, at least one rearward edge 836 of the trailer 804 does not extend beyond or trail behind a rear end 727 of the handle 728. The rearward edge 836 may be a straight rear end of the trailer 804, an edge recessed with respect to a more rearward edge of the trailer 804 so as to provide room for an operator's feet, or the like. The rear end 727 of the handle 728 may be defined by handle grips. The rearward edge 836 of the trailer 804 is disposed between the rear end 727 of the handle 728 and the chassis 710 to enable an operator to walk behind the chassis 710 while gripping the handle 728 without tripping on the trailer 804. Accordingly, and in contrast to prior art floor finishing machines, the vacuum system V may be trailered behind the floor finishing apparatus 700 between the apparatus 700 and an operator or between the frame 710 of the apparatus 700 and the rear end 727 of the handle 728 of the apparatus 700.

Figure 10:
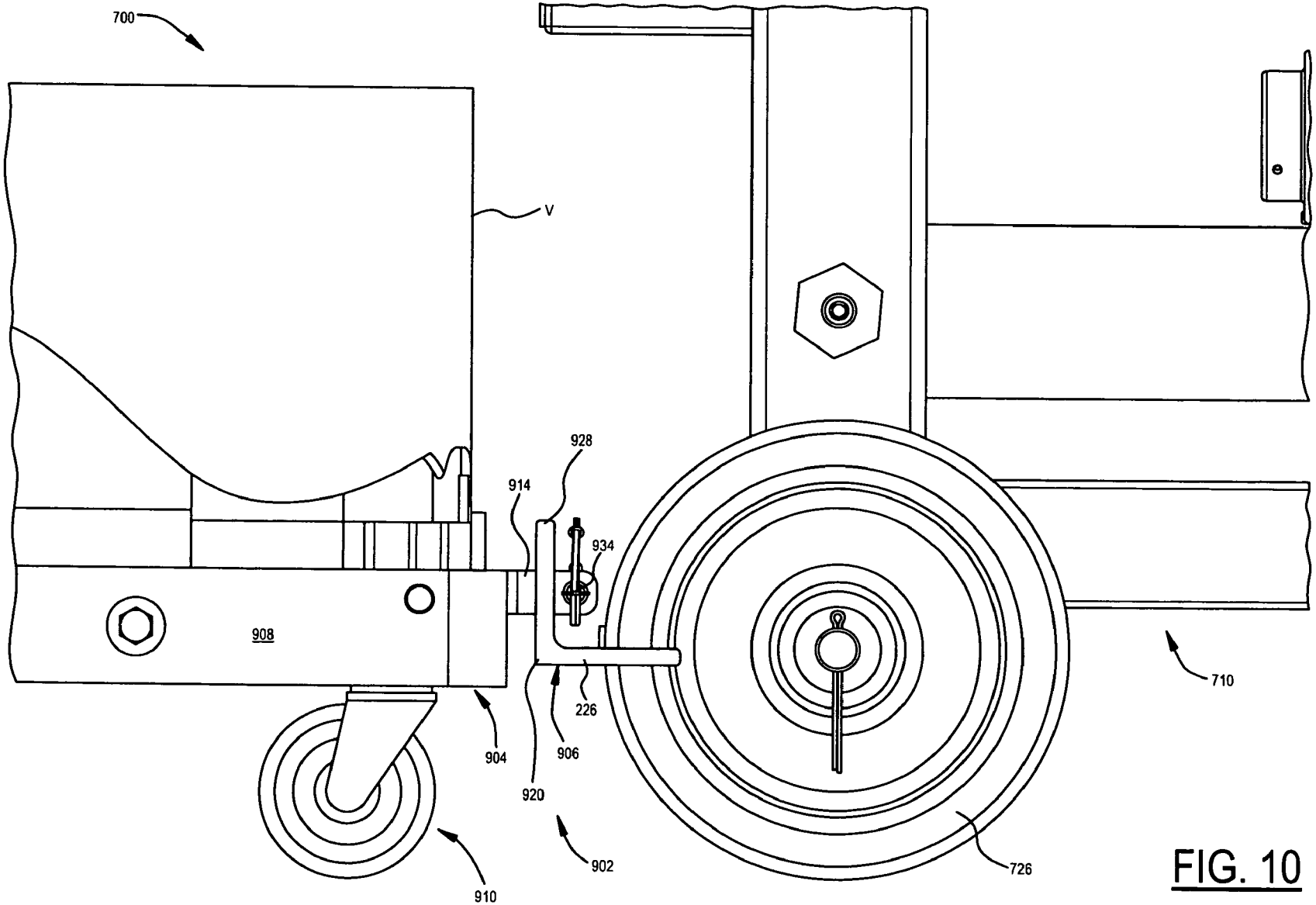
FIG. 10 is a fragmentary side view of a second embodiment of a trailer coupled to the chassis using a tow bar.
Figure 11:
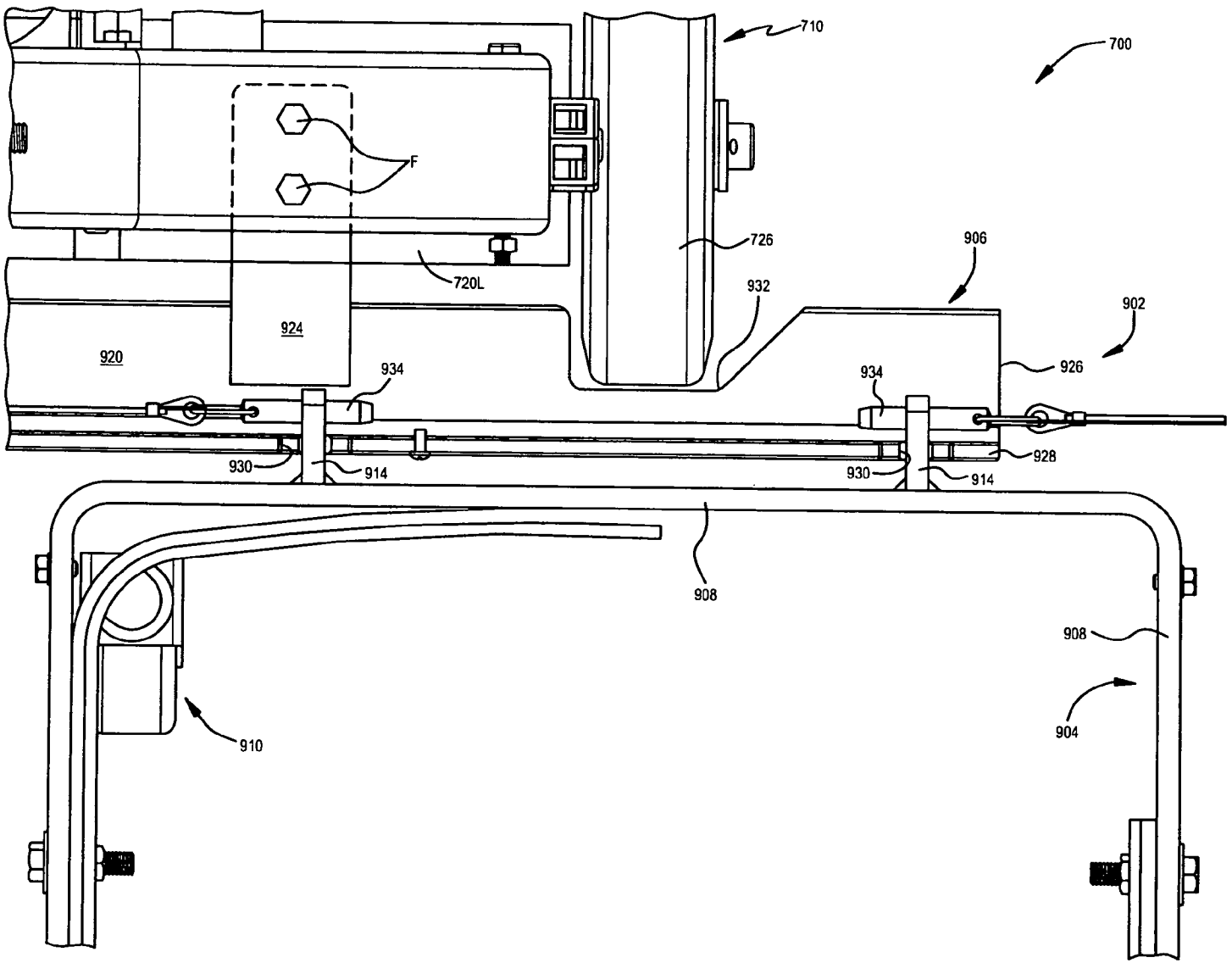
FIG. 11 is a fragmentary top plan view of the trailer coupled to the chassis as shown in FIG. 10.

Referring now in general to FIGS. 10 and 11, the apparatus 700 may further include another accessory arrangement 902. The accessory arrangement 902 may include a trailer 904 coupled to the chassis 710 of the apparatus 700 such as by being removably attachable to a generally horizontally extending tow bar 906 carried by the chassis 710. The accessory arrangement 902 may be used, for example, to carry the vacuum system V (FIG. 10) or a portion thereof, such that the trailer 904 may be a vacuum trailer. Vacuum hoses (not shown) may be routed through the chassis 710 as described previously.

The trailer 904 may include a frame 908, wheels 910 suitably mounted to the frame 908, and mounting brackets 914 coupled to a forward portion of the frame 908 to attach the trailer 904 to the chassis 710. The trailer 904 may be constructed according to any suitable shapes and sizes and from any suitable materials and components, for example, several angle irons and/or flat steel plates welded or fastened together, a unitary frame injection molded from plastic, or the like. All of the wheels 910, or any combination thereof, may be rotationally fixed types of wheels, or may be swivel or caster types of wheels, or the like.

As shown in FIGS. 12-15, the tow bar 906 may include an angle iron 920, and one or more mounting brackets 924 welded or otherwise coupled to the angle iron 920 and adapted to be attached to the lower crossmember 720L (FIG. 10) of the chassis 710 (FIG. 10). The angle iron 920 may include a first flange 926 coupled to the mounting brackets 924, and a second flange 928 having one or more open slots 930 therein for cooperation with the mounting brackets 914 (FIG. 1) of the trailer 904 (FIG. 11). The first flange 926 may also include wheel cutouts 932.

Referring again to FIGS. 10 and 11, the tow bar 906 can be removably coupled to the crossmember 720L using any suitable fasteners F, and is mounted to the chassis 710 such that the wheels 726 extend into the wheel cutouts 932 of the tow bar 906. Also, the trailer mounting brackets 914 are placed into registration with the open slots 930 of the tow bar 906, and one or more retaining pins 934 are able to be extended through corresponding holes in the mounting brackets 914 of the trailer 904 to retain the trailer 904 to the chassis 710.

Each of the above-disclosed embodiments includes elements and features that may be interchanged with any and all of the other above-disclosed embodiments to produce a novel and nonobvious floor finishing machine.

Variations and modifications are possible without departing from the scope and spirit of the present invention as defined by the appended claims.

The embodiments in which an exclusive property or privilege is claimed are defined as follows:

1. A floor finishing apparatus comprising:

a chassis;

a housing pivotably mounted to said chassis, said housing having a mounting surface, said housing at least partially defining a chamber;

a plurality of floor finishing units mounted to said mounting surface of said housing;

wherein said housing is pivotably mounted to a generally horizontal cross-member of said chassis; and wherein said chassis includes at least two uprights, at least one crossmember extending between the at least two uprights, and at least one support arm carried by the at least one crossmember, and wherein said housing includes at least one mount pivotally mounted to the at least one support arm.

2. The floor finishing apparatus of claim 1, further comprising a pivot member disposed through the at least one support arm and the at least one mount.

3. The floor finishing apparatus of claim 2, further comprising at least one pin removably carried through the at least one support arm and the at least one mount with said pin being spaced from said pivot member to pivotably fix said housing to said chassis.

4. The floor finishing apparatus of claim 2, further comprising at least one rolling device carried by the housing and adapted to contact the ground to assist the housing in being pivoted with respect to the chassis.

5. The floor finishing apparatus of claim 4, further comprising a pivot member disposed through the at least one support arm and the at least one mount, wherein the at least one rolling device is carried at a rear edge of the housing, such that a center of gravity of the housing and floor finishing units is over center to the rear of the pivot member to maintain a stable position during rolling of the apparatus.

6. The floor finishing apparatus of claim 5, wherein the at least one rolling device includes a mounting bracket attached to the housing and a wheel attached to the mounting bracket.

7. The floor finishing apparatus of claim 5, further comprising at least one handle carried by the housing.

8. The floor finishing apparatus of claim 1, wherein said housing further includes:

a skirt mounted therearound to further define said chamber; and at least one vacuum port provided through said housing in communication with said chamber.

9. The floor finishing apparatus of claim 1, wherein at least a portion of said plurality of floor finishing units diametrically overlap in the direction of travel of said floor finishing apparatus.

10. The floor finishing apparatus of claim 1, wherein at least a portion of said plurality of floor finishing units are arranged in a delta pattern.

11. A floor finishing apparatus comprising:

a chassis including:

at least two uprights;

at least one crossmember extending between the at least two uprights;

at least two wheels carried by at least one of the uprights or at least one crossmember; and at least two support arms having fixed ends attached to the at least one crossmember, being cantilevered from the at least one crossmember, and terminating in free ends;

a housing pivotally mounted to said chassis and at least partially defining a chamber, said housing including:

a mounting surface; and at least two mounts carried on the mounting surface and pivotably mounted to the free ends of the at least two support arms of the chassis; and a plurality of floor finishing units mounted to said mounting surface of said housing.

12. The floor finishing apparatus of claim 11, further comprising:

a pivot pin disposed through at least one of the support arms and mounts; and at least one additional pin removably carried through at least one of the support arms and mounts to pivotably fix the housing in position with respect to the chassis.

13. The floor finishing apparatus of claim 12, further comprising at least one rolling device carried by an upper portion of the housing and adapted to contact the ground to assist the housing in being pivoted with respect to the chassis from its operating position.

14. The floor finishing apparatus of claim 13, further comprising a pivot member disposed through the at least one support arm and at least one of the mounts, wherein the at least one rolling device is carried at a rear edge of the housing, such that a center of gravity of the housing and floor finishing units is over center to the rear of the pivot member to maintain a stable position during rolling of the apparatus, and wherein the at least one rolling device includes a mounting bracket attached to the housing and a wheel attached to the mounting bracket.

15. The floor finishing apparatus of claim 14, further comprising at least one handle carried by the housing.

16. The floor finishing apparatus comprising:

a chassis;

a plurality of finishing units disposed frontwardly of the chassis;

a handle coupled to the chassis and extending rearwardly from the chassis;

a wheeled vacuum system, being coupled to the chassis, and extending rearwardly from the chassis with wheels of said vacuum system being behind the wheels of said chassis;

a trailer carrying at least a portion of the wheeled vacuum system;

a generally horizontally extending tow bar carried by the chassis to couple the trailer to the chassis; and wherein the chassis includes a crossmember, and the tow bar includes at least one mounting bracket adapted to be attached to the crossmember and an angle iron coupled to the at least one mounting bracket, wherein the angle iron includes a flange having at least one open slot therein.

17. The floor finishing apparatus of claim 16, wherein the trailer includes a frame including at least mounting bracket for cooperation with the at least one open slot of the angle iron flange.

18. The floor finishing apparatus of claim 17, further comprising at least one retaining pin extendable through at least one hole in the at least one mounting bracket of the trailer to retain the trailer to the chassis.

19. A floor finishing apparatus comprising:

a chassis;

a housing pivotably mounted to said chassis, said housing carrying at least one floor finishing unit and pivoted to a first usable position with the at least one floor finishing unit resting on the ground;

a handle and a first set of wheels coupled to the chassis to permit the floor finishing apparatus to move on said first set of wheels when said handle pivots said chassis to lift said housing off the ground when in the first usable position with respect to said handle;

at least one rolling device carried by the housing and adapted to contact the ground to when the housing is pivoted to a second position with respect to the chassis; and said at least one rolling device is carried in proximity to a rear edge of the housing, such that a center of gravity of the housing and floor finishing units is over center to the rear of the pivot member to maintain a stable position of said pivoted housing when in the second position during rolling of the floor finishing apparatus.

20. The floor finishing apparatus of claim 19, wherein the at least one rolling device includes a mounting bracket attached to the housing and a wheel attached to the mounting bracket.

* * * * *